US007520955B1

(12) United States Patent
Zuniga et al.

(10) Patent No.: US 7,520,955 B1
(45) **Date of Patent: *Apr. 21, 2009**

(54) CARRIER HEAD WITH A MULTILAYER RETAINING RING FOR CHEMICAL MECHANICAL POLISHING

(75) Inventors: Steven M. Zuniga, Soquel, CA (US); Thomas H. Osterheld, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/848,830

(22) Filed: May 3, 2001

Related U.S. Application Data

(63) Continuation of application No. 09/090,679, filed on Jun. 3, 1998, now Pat. No. 6,251,215.

(51) Int. Cl.
*B24B 5/00* (2006.01)
*B24B 29/00* (2006.01)

(52) U.S. Cl. ..... 156/345.14; 216/85; 216/88; 216/89; 451/285; 451/286

(58) Field of Classification Search ..... 156/345, 156/345.14; 216/85, 88, 89; 451/285, 286
See application file for complete search history.

(56) References Cited

U.S. PATENT DOCUMENTS

| | | | |
|---|---|---|---|
| 5,205,082 | A | 4/1993 | Shendon et al. |
| 5,423,558 | A | 6/1995 | Koeth et al. |
| 5,533,924 | A | 7/1996 | Stroupe et al. |
| 5,584,751 | A | 12/1996 | Kobayashi et al. |
| 5,597,346 | A | 1/1997 | Hempel, Jr. |
| 5,605,488 | A | 2/1997 | Ohashi et al. |
| 5,635,083 | A | 6/1997 | Breivogel et al. |
| 5,643,053 | A | 7/1997 | Shendon |
| 5,643,061 | A | 7/1997 | Jackson et al. |
| 5,645,474 | A | 7/1997 | Kubo et al. |
| 5,647,789 | A | 7/1997 | Kitta et al. |
| 5,664,988 | A | 9/1997 | Stroupe et al. |
| 5,681,215 | A | 10/1997 | Sherwood |
| 5,695,392 | A | 12/1997 | Kim |
| 5,738,574 | A | 4/1998 | Tolles et al. |
| 5,749,771 | A | 5/1998 | Isobe et al. |
| 5,759,918 | A | 6/1998 | Hoshizaki et al. |
| 5,762,544 | A | 6/1998 | Zuniga et al. |
| 5,795,215 | A | 8/1998 | Guthrie et al. |

(Continued)

FOREIGN PATENT DOCUMENTS

| | | |
|---|---|---|
| EP | 0 747 167 A2 | 12/1996 |

(Continued)

OTHER PUBLICATIONS

Machine Design: "High Performance Resins Take Charge and More" Nov. 7, 1996.*

(Continued)

*Primary Examiner*—Roberts Culbert
(74) *Attorney, Agent, or Firm*—Fish & Richardson P.C.

(57) ABSTRACT

A carrier head for a chemical mechanical polishing apparatus includes a retaining ring having a flexible lower portion and a rigid upper portion.

49 Claims, 3 Drawing Sheets

U.S. PATENT DOCUMENTS

| | | | | |
|---|---|---|---|---|
| 5,803,799 | A | 9/1998 | Volodarsky et al. | |
| 5,851,140 | A | 12/1998 | Barns et al. | |
| 5,879,220 | A | 3/1999 | Hasegawa et al. | |
| 5,906,532 | A | 5/1999 | Nakajima et al. | |
| 5,931,725 | A | 8/1999 | Inaba et al. | |
| 5,944,593 | A * | 8/1999 | Chiu et al. | 451/442 |
| 5,948,204 | A | 9/1999 | Maveety et al. | |
| 6,019,670 | A | 2/2000 | Cheng et al. | |
| 6,024,630 | A | 2/2000 | Shendon et al. | |
| 6,068,548 | A * | 5/2000 | Vote et al. | 451/398 |
| 6,077,385 | A | 6/2000 | Kimura et al. | |
| 6,113,479 | A | 9/2000 | Sinclair et al. | |
| 6,183,354 | B1 * | 2/2001 | Zuniga et al. | 451/285 |
| 6,244,932 | B1 * | 6/2001 | Govzman et al. | 451/8 |
| 6,251,215 | B1 | 6/2001 | Zuniga et al. | |
| 6,277,008 | B1 | 8/2001 | Masuta et al. | |
| 6,436,228 | B1 | 8/2002 | Zuniga et al. | |
| 6,716,094 | B2 | 4/2004 | Shendon et al. | |

FOREIGN PATENT DOCUMENTS

| | | | |
|---|---|---|---|
| EP | 747167 | A2 * | 12/1996 |
| EP | 0 776 730 | A | 6/1997 |
| EP | 0 790 100 | A1 | 8/1997 |
| EP | 0 841 123 | A1 | 5/1998 |
| EP | 0 988 931 | A2 | 3/2000 |
| GB | 2 307 342 | A | 5/1997 |
| GB | 2 336 121 | A | 10/1999 |
| JP | 62-50047 | | 3/1987 |
| JP | 06-039705 | | 2/1994 |
| JP | 06-039705 | A2 | 2/1994 |
| JP | 08-150558 | | 6/1996 |
| JP | 08-229804 | | 9/1996 |
| JP | 08-257893 | | 10/1996 |
| JP | 08-264627 | | 10/1996 |
| JP | 09-019863 | | 1/1997 |
| JP | 10-034530 | | 2/1998 |
| JP | 10-058309 | | 3/1998 |
| JP | 10-058309 | A | 3/1998 |
| JP | 10-058309 | A5 | 3/1998 |
| JP | 10-094959 | | 4/1998 |
| JP | 11-291162 | | 10/1999 |
| WO | WO 97/20660 | | 6/1997 |

OTHER PUBLICATIONS

DSM: "Advanced Engineering Plastics for the Semiconductor Industry" 1997.*

Notice of Reasons for Revocation, Dispatched Aug. 27, 2004, Japanese Opposition No. 2003-72977.

"3M Scotch-Weld™ DP-460 Off-White, DP-420 Off-White Epoxy Adhesives", Technical Data, Dec. 1994.

Jordon Rotheiser, "Joining Of Plastics, Handbook For Designers And Engineers", pp. 6-8; 186-279; 343-412; 443-456, Hanser Gardner Publications, Inc., 1999.

"Notice of Reason(s) for Rejection", Japanese Application No. 2000-551919, Dispatch No. 230880, Jul. 15, 2002.

Decision on Opposition, Japanese Application No. 2000-551919, May 17, 2005, Dispatch No. 039203, May 17, 2005.

"Order Granting in Part and Denying in Part Applied Materials' Motion for Summary Judgment and Denying Plaintiff's Motion for Leave to Seek Reconsideration of Two Factual Findings", USDC of Northern California, Case No. C01-04794 WHA, filed Dec. 10, 2004.

"Consent Judgment", USDC of Northern California, Case No. C01-04794 WHA, filed Feb. 18, 2005.

"High-Tech Resins Boost Chip Production", Machine Design, Nov. 7, 1996, pp. 52+. ["Machine Design"].

"Advanced Engineering Plastics for the Semiconductor Industry", DSM Engineering (Polymer Corporation), 1996. ["DSM"].

"Advanced Engineering Plastics for the Semiconductor Industry", DSM Engineering (Polymer Corporation), 1997. ["DSM"].

"SPM Purchase Orders for PPS Techtron Purchased from Laird Plastics, Invoice Copies from Laird", 1996. Laird Plastics.

"SPM's PPS Ring Sales History", Jan. 1997 thru Nov. 1999.

* cited by examiner

CARRIER HEAD WITH A MULTILAYER RETAINING RING FOR CHEMICAL MECHANICAL POLISHING

CROSS-REFERENCE TO RELATED APPLICATIONS

This application is a continuation application of and claims priority to U.S. patent application Ser. No. 09/090,679, filed Jun. 3, 1998, issued as U.S. Pat. No. 6,251,215.

BACKGROUND

The present invention relates generally to chemical mechanical polishing of substrates, and more particularly to a carrier head for a chemical mechanical polishing apparatus.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect", i.e., the tendency of the edge of the substrate to be polished at a different rate than the center of the substrate. The edge effect typically results in over-polishing (the removal of too much material from the substrate) at the substrate perimeter, e.g., the outermost five to ten millimeters of a 200 mm wafer. Over-polishing reduces the overall flatness of the substrate, causing the edge of the substrate to be unsuitable for integrated circuit fabrication and decreasing the process yield.

SUMMARY

In one aspect, the invention is directed to a carrier head for a chemical mechanical polishing apparatus. The carrier head has a substrate mounting surface and a retaining ring to maintain a substrate beneath the mounting surface during polishing. The retaining ring includes a lower portion having a bottom surface for contacting a polishing pad during polishing and made of a first material, and an upper portion made of a second material which is more rigid than the first material.

Implementations of the invention may include the following. The first material may be a plastic, e.g., polyphenylene sulfide, polyethylene terephthalate, polyetheretherketone, or polybutylene terephthalate, which is substantially inert to a chemical mechanical polishing process. The second material may be a metal, e.g., steel, aluminum, or molybdenum, or a ceramic. The lower portion may be thicker than a substrate to be polished, e.g., between about 100 and 400 mils thick. The first material may provide a durometer measurement between about 80 and 95 on the Shore D scale. The second material may have an elastic modulus about ten to one-hundred, e.g., fifty times the elastic modulus of the first material. The lower portion may be adhesively attached, e.g., with a slow curing epoxy, or press fit to the upper portion.

In another aspect of the carrier head, the lower portion is made of a first material having a first elastic modulus and the upper portion is made of a second material having a second elastic modulus, and the second elastic modulus is selected to be sufficiently larger than the first elastic modulus to substantially prevent deflection of the lower surface of the retaining ring during polishing.

In another aspect of the carrier head, the lower portion is made of a first material having a first elastic modulus and the upper portion is made of a second material having a second elastic modulus, and the second elastic modulus is selected to be sufficiently larger than the first elastic modulus to substantially prevent deformation of the lower surface of the retaining ring where the retaining ring is joined to the carrier head.

In another aspect, the invention is directed to a retaining ring for a carrier head having a mounting surface for a substrate. The retaining ring has a generally annular lower portion having a bottom surface for contacting a polishing pad during polishing and made of a first material which is inert in a chemical mechanical polishing process, and a generally annular upper portion joined to the lower portion and made of a second material which is more rigid than the first material.

In another aspect, the invention is directed to a chemical mechanical polishing system with a rotatable polishing pad, a slurry supply to dispense a slurry onto the polishing pad, and a carrier head having a substrate mounting surface and a retaining ring to maintain a substrate beneath the mounting surface during polishing. The retaining ring includes a lower portion for contacting a polishing pad during polishing and made of a first material, and an upper portion made of a second material which is more rigid than the first material.

Advantages of the invention may include the following. The edge effect is reduced, and the resulting flatness and finish of the substrate are improved.

Other advantages and features of the invention will be apparent from the following description, including the drawings and claims.

DETAILED DESCRIPTION

Figure 1:
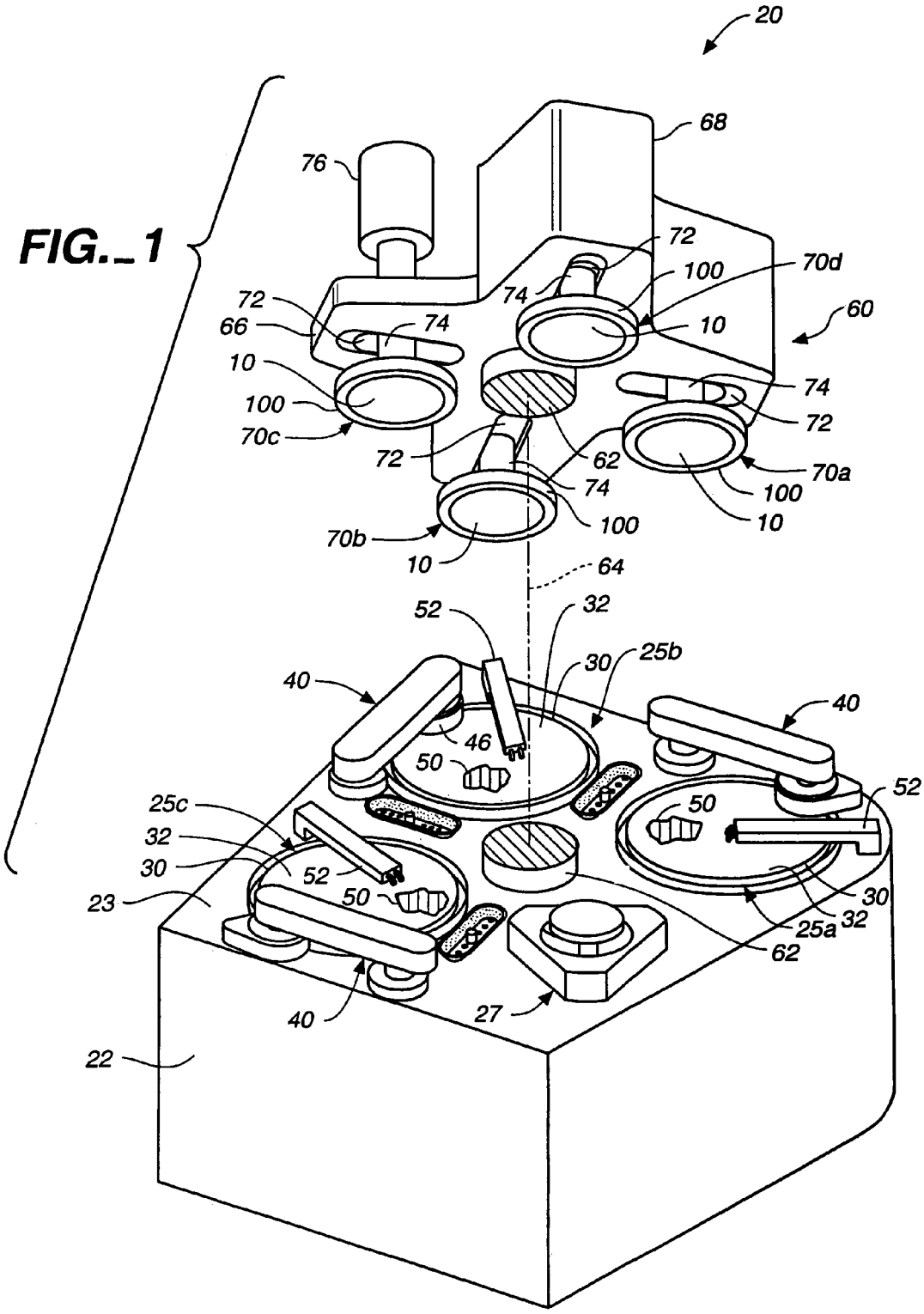
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is hereby incorporated by reference.

The CMP apparatus 20 includes a lower machine base 22 with a table top 23 mounted thereon and a removable upper outer cover (not shown). Table top 23 supports a series of polishing stations 25*a*, 25*b* and 25*c*, and a transfer station 27 for loading and unloading the substrates. Transfer station 27 may form a generally square arrangement with the three polishing stations 25*a*, 25*b* and 25*c*.

Each polishing station 25*a*-25*c* includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25*a*-25*c* may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against the polishing pads of polishing stations 25*a*-25*c*. One of the carrier head systems receives a substrate from and delivers the substrate to transfer station 27. The carousel motor may orbit carrier head systems 70*a*-70*d*, and the substrates attached thereto, about carousel axis 64 between the polishing stations and the transfer station.

Each carrier head system 70*a*-70*d* includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, e.g., those of carrier head systems 70*a*-70*c*, are positioned at and above respective polishing stations 25*a*-25*c*. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
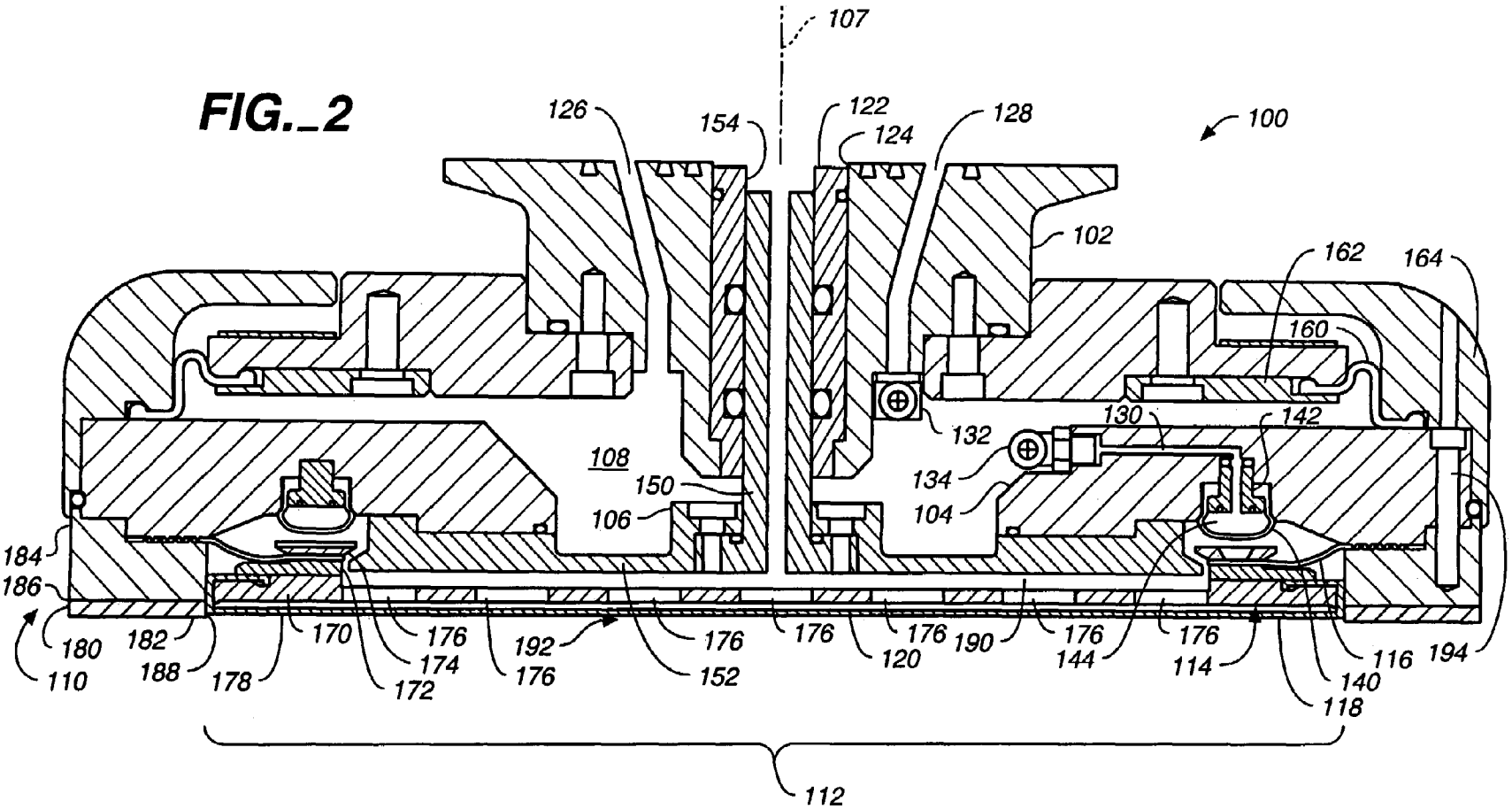
FIG. 2 is a schematic cross-sectional view of a carrier head according to the present invention.

Referring to FIG. 2, carrier head 100 includes a housing 102, a base 104, a gimbal mechanism 106, a loading chamber 108, a retaining ring 110, and a substrate backing assembly 112. A description of a similar carrier head may be found in U.S. Pat. No. 6,183,354, the entire disclosure of which is hereby incorporated by reference.

The housing 102 can be connected to drive shaft 74 to rotate therewith during polishing about an axis of rotation 107 which is substantially perpendicular to the surface of the polishing pad during polishing. The loading chamber 108 is located between housing 102 and base 104 to apply a load, i.e., a downward pressure, to base 104. The vertical position of base 104 relative to polishing pad 32 is also controlled by loading chamber 108.

The substrate backing assembly 112 includes a support structure 114, a flexure diaphragm 116 connecting support structure 114 to base 104, and a flexible member or membrane 118 connected to support structure 114. The flexible membrane 118 extends below support structure 114 to provide a mounting surface 120 for the substrate. Pressurization of a chamber 190 positioned between base 104 and substrate backing assembly 112 forces flexible membrane 118 downwardly to press the substrate against the polishing pad.

The housing 102 is generally circular in shape to correspond to the circular configuration of the substrate to be polished. A cylindrical bushing 122 may fit into a vertical bore 124 extending through the housing, and two passages 126 and 128 may extend through the housing for pneumatic control of the carrier head.

The base 104 is a generally ring-shaped body located beneath housing 102. The base 104 may be formed of a rigid material such as aluminum, stainless steel or fiber-reinforced plastic. A passage 130 may extend through the base, and two fixtures 132 and 134 may provide attachment points to connect a flexible tube between housing 102 and base 104 to fluidly couple passage 128 to passage 130.

An elastic and flexible membrane 140 may be attached to the lower surface of base 104 by a clamp ring 142 to define a bladder 144. Clamp ring 142 may be secured to base 104 by screws or bolts (not shown). A first pump (not shown) may be connected to bladder 144 to direct a fluid, e.g., a gas, such as air, into or out of the bladder and thereby control a downward pressure on support structure 114 and flexible membrane 118.

Gimbal mechanism 106 permits base 104 to pivot with respect to housing 102 so that the base may remain substantially parallel with the surface of the polishing pad. Gimbal mechanism 106 includes a gimbal rod 150 which fits into a passage 154 through cylindrical bushing 122 and a flexure ring 152 which is secured to base 104. Gimbal rod 150 may slide vertically along passage 154 to provide vertical motion of base 104, but it prevents any lateral motion of base 104 with respect to housing 102.

An inner edge of a rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. Rolling diaphragm 160 may be a generally ring-shaped sixty mil thick silicone sheet. A second pump (not shown) may be fluidly connected to loading chamber 108 to control the pressure in the loading chamber and the load applied to base 104.

The support structure 114 of substrate backing assembly 112 is located below base 104. Support structure 114 includes a support plate 170, an annular lower clamp 172, and an annular upper clamp 174. Support plate 170 may be a generally disk-shaped rigid member with a plurality of apertures 176 therethrough. In addition, support plate 170 may have a downwardly-projecting lip 178 at its outer edge.

Flexure diaphragm 116 of substrate backing assembly 112 is a generally planar annular ring. An inner edge of flexure diaphragm 116 is clamped between base 104 and retaining ring 110, and an outer edge of flexure diaphragm 116 is clamped between lower clamp 172 and upper clamp 174. The flexure diaphragm 116 is flexible and elastic, although it could be rigid in the radial and tangential directions. Flexure diaphragm 116 may formed of rubber, such as neoprene, an elastomeric-coated fabric, such as NYLON™ or NOMEX™, plastic, or a composite material, such as fiberglass.

Flexible membrane 118 is a generally circular sheet formed of a flexible and elastic material, such as chloroprene or ethylene propylene rubber. A portion of flexible membrane 118 extends around the edges of support plate 170 to be clamped between the support plate and lower clamp 172.

The sealed volume between flexible membrane 118, support structure 114, flexure diaphragm 116, base 104, and gimbal mechanism 106 defines pressurizable chamber 190. A third pump (not shown) may be fluidly connected to chamber 190 to control the pressure in the chamber and thus the downward forces of the flexible membrane on the substrate.

Retaining ring 110 may be a generally annular ring secured at the outer edge of base 104, e.g., by bolts 194 (only one is shown in the cross-sectional view of FIG. 2). When fluid is pumped into loading chamber 108 and base 104 is pushed downwardly, retaining ring 110 is also pushed downwardly to apply a load to polishing pad 32. An inner surface 188 of retaining ring 110 defines, in conjunction with mounting surface 120 of flexible membrane 118, a substrate receiving recess 192. The retaining ring 110 prevents the substrate from escaping the substrate receiving recess.

Figure 3:
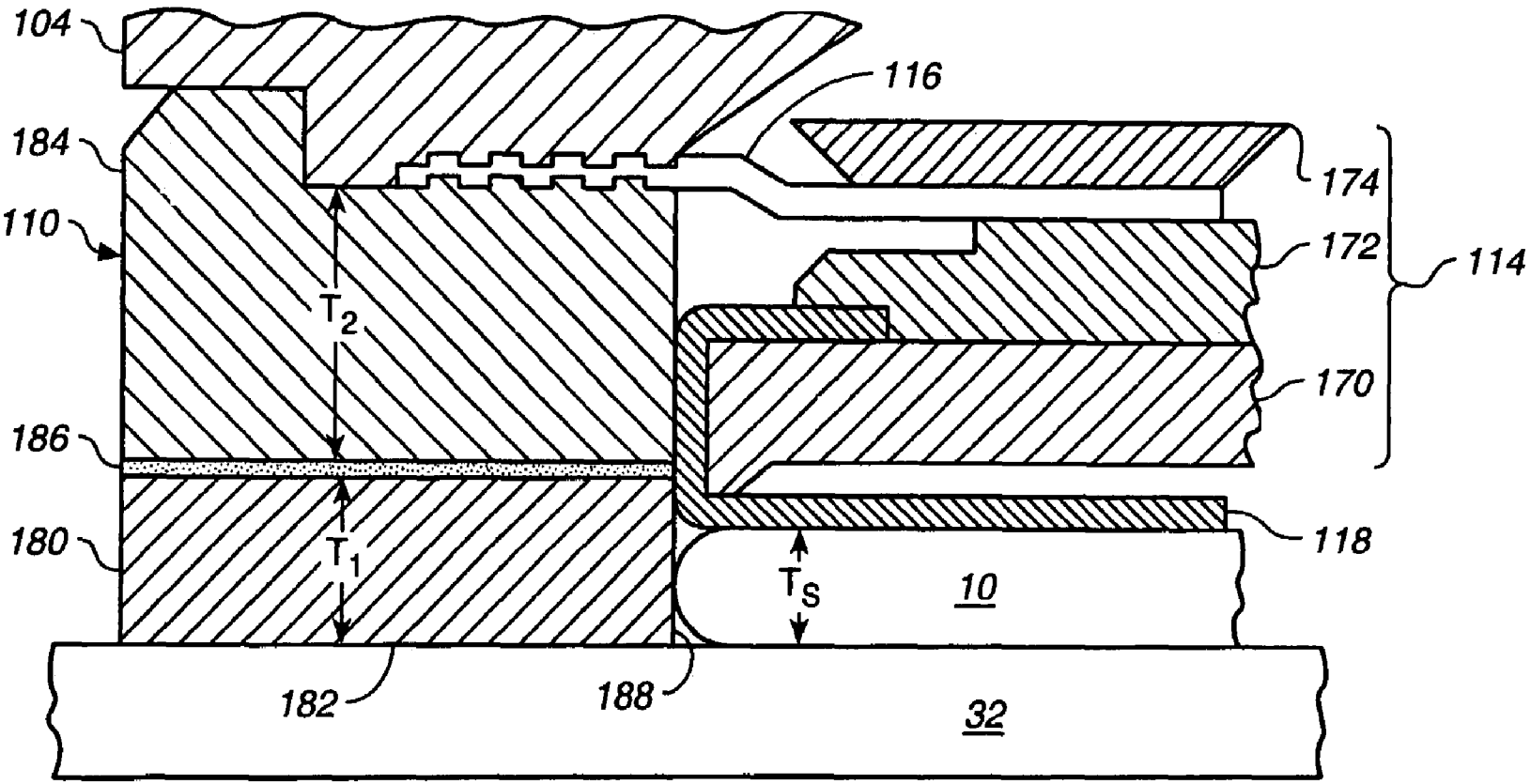
FIG. 3 is an enlarged view of the carrier head of FIG. 2 showing a retaining ring.

Referring to FIG. 3, retaining ring 110 includes multiple sections, including an annular lower portion 180 having a bottom surface 182 that may contact the polishing pad, and an annular upper portion 184 connected to base 104. Lower portion 180 may be bonded to upper portion 184 with an adhesive layer 186.

The lower portion is formed of a material which is chemically inert in a CMP process. In addition, lower portion 180 should be sufficiently elastic that contact of the substrate edge against the retaining ring does not cause the substrate to chip or crack. On the other hand, lower portion 180 should not be so elastic that downward pressure on the retaining ring causes lower portion 180 to extrude into substrate receiving recess 192. Specifically, the material of the lower portion 180 may have a durometer measurement of about 80-95 on the Shore D scale. In general, the elastic modulus of the material of lower portion 180 may be in the range of about $0.3\text{-}1.0\times10^6$ psi. The lower portion should also be durable and have a low wear rate. However, it is acceptable for lower portion 180 to be gradually worn away, as this appears to prevent the substrate edge from cutting a deep grove into inner surface 188. For example, lower portion 180 may be made of a plastic, such as polyphenylene sulfide (PPS), available from DSM Engineering Plastics of Evansville, Ind., under the trade name Techtron™. Other plastics, such as DELRIN™, available from Dupont of Wilmington, Del., polyethylene terephthalate (PET), polyetheretherketone (PEEK), or polybutylene terephthalate (PBT), or a composite material such as ZYMAXX™, also available from Dupont, may be suitable.

The thickness $T_1$ of lower portion 180 should be larger than the thickness $T_s$ of substrate 10. Specifically, the lower portion should be thick enough that the substrate does not brush against the adhesive layer when the substrate is chucked by the carrier head. On the other hand, if the lower portion is too thick, the bottom surface of the retaining ring will be subject to deformation due to the flexible nature of the lower portion. The initial thickness of lower portion 180 may be about 200 to 400 mils (with grooves having a depth of 100 to 300 mils). The lower portion may be replaced when the grooves have been worn away. Thus, the thickness T1 of lower portion 180 may vary between about 400 mils (assuming an initial thickness of 400 mils) and about 100 mils (assuming that grooves 300 mils deep were worn away). If the retaining ring does not include grooves, the lower portion may be replaced when its thickness is equal to the substrate thickness.

The bottom surface of the lower portion 180 may be substantially flat, or it may have a plurality of channels or grooves 196 (shown in phantom in FIG. 3) to facilitate the transport of slurry from outside the retaining ring to the substrate.

The upper portion 184 of retaining ring 110 is formed of a rigid material, such as a metal, e.g., stainless steel, molybdenum, or aluminum, or a ceramic, e.g., alumina, or other exemplary materials. The material of the upper portion may have an elastic modulus of about $10\text{-}50\times10^6$ psi, i.e., about ten to one hundred times the elastic modulus of the material of the lower portion. For example, the elastic modulus of the lower portion may be about $0.6\times10^6$ psi, the elastic modulus of the upper portion may be about $30\times10^6$ psi, so that the ratio is about 50:1. The thickness $T_2$ of upper portion 184 should be greater than the thickness $T_1$ of lower portion 182. Specifically, the upper portion may have a thickness $T_2$ of about 300-500 mils.

The adhesive layer 186 may be a two-part slow-curing epoxy. Slow curing generally indicates that the epoxy takes on the order of several hours to several days to set. The epoxy may be Magnobond-6375™, available from Magnolia Plastics of Chamblee, Ga. Alternately, instead of being adhesively attached, the lower layer may be connected with screws or press-fit to the upper portion.

It appears that the flatness of the bottom surface of the retaining ring has a bearing on the edge effect. Specifically, if the bottom surface is very flat, the edge effect is reduced. If the retaining ring is relatively flexible, it can be deformed where it is joined to the base, e.g., by bolts 194. This deformation creates a non-planar bottom surface, thereby increasing the edge effect. Although the retaining ring can be lapped or machined after installation on the carrier head, lapping tends to embed debris in the bottom surface which can damage the substrate or contaminate the CMP process, and machining is time-consuming and inconvenient. On the other hand, an entirely rigid retaining ring, such as a stainless steel ring, can cause the substrate to crack or contaminate the CMP process.

With the retaining ring of the present invention, the rigidity of upper portion 184 of retaining ring 110 increases the overall flexural rigidity of the retaining ring, e.g., by a factor of 30-40 times, as compared to a retaining ring formed entirely of a flexible material such as PPS. The increased rigidity provided by the rigid upper portion reduces or eliminates this deformation caused by the attachment of the retaining ring to the base, thereby reducing the edge effect. Furthermore, the retaining ring need not be lapped after it is secured to the carrier head. In addition, the PPS lower portion is inert in the CMP process, and is sufficiently elastic to prevent chipping or cracking of the substrate edge.

Another benefit of the increased rigidity of the retaining ring of the present invention is that it reduces the sensitivity of the polishing process to pad compressibility. Without being limited to any particular theory, one possible contribution to the edge effect, particularly for flexible retaining rings, is what may be termed "deflection" of the retaining ring. Specifically, the force of the substrate edge on the inner surface of the retaining ring at the trailing edge of the carrier head may cause the retaining ring to deflect, i.e., locally twist slightly about an axis parallel to the surface of the polishing pad. This forces the inner diameter of the retaining ring more deeply into the polishing pad, generates increased pressure on the polishing pad, and causes the polishing pad material to "flow" and be displaced toward the edge of the substrate. The displacement of the polishing pad material depends upon the elastic properties of the polishing pad. Thus, a relatively flexible retaining ring which can deflect into the pad, makes the polishing process extremely sensitive to the elastic properties of the pad material. However, the increased rigidity provided by the rigid upper portion decreases the deflection of the retaining ring, thereby reducing pad deformation, sensitivity to pad compressibility, and the edge effect.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a rigid base;

a substrate mounting surface that is vertically movable relative to the base; and a retaining ring to maintain a substrate beneath the mounting surface during polishing, the retaining ring including a substantially annular lower portion having a bottom surface for contacting a polishing pad during polishing, wherein the lower portion is made of a plastic, and a substantially annular upper portion having a bottom surface joined to the lower portion and a top surface fixed to and abutting the base such that the retaining ring is vertically fixed relative to the base, wherein the upper portion is made of a metal which is more rigid than the plastic;

wherein the retaining ring is removable from the base as a unit so that the upper portion remains secured to the lower portion while the retaining ring is removed without disassembly of the base.

2. The carrier head of claim 1, wherein the plastic is substantially inert to a chemical mechanical polishing process.

3. The carrier head of claim 1, wherein the lower portion has a durometer measurement between about 80 and 95 on the Shore D scale.

4. The carrier head of claim 1, wherein the lower portion is between about 100 and 400 mils thick.

5. The carrier head of claim 4, wherein the upper portion is thicker than the lower portion.

6. The carrier head of claim 1, wherein the plastic is selected from the group consisting of polyphenylene sulfide, polyethylene terephthalate, polyetheretherketone, and polybutylene terephthalate.

7. The carrier head of claim 6, wherein the plastic is polyphenylene sulfide.

8. The carrier head of claim 1, wherein the metal is selected from the group consisting of steel, aluminum, and molybdenum.

9. The carrier head of claim 1, wherein the metal has an elastic modulus about ten to one-hundred times the elastic modulus of the plastic.

10. The carrier head of claim 1, wherein the lower portion is adhesively attached to the upper portion.

11. The carrier head of claim 10, wherein the adhesive is an epoxy.

12. The carrier head of claim 1, wherein the lower portion is press fit to the upper portion.

13. A retaining ring for a carrier head having a mounting surface for a substrate, comprising:

a generally annular lower portion having a bottom surface for contacting a polishing pad during polishing and a top surface, the lower portion made of a plastic; and a generally annular upper portion having a bottom surface secured to the top surface of the lower portion and a top surface configured to be mechanically affixed to and abut a rigid base of a carrier head, wherein the upper portion is made of a metal which is more rigid than the plastic, wherein the lower portion is secured to the upper portion and the top surface is configured such that the retaining ring is removable as a unit from the base so that the upper portion remains secured to the lower portion while the retaining ring is removed.

14. The retaining ring of claim 13, wherein the plastic is substantially inert to a chemical mechanical polishing process.

15. The retaining ring of claim 13, wherein the lower portion has a durometer measurement between about 80 and 95 on the Shore D scale.

16. The retaining ring of claim 13, wherein the lower portion is between about 100 and 400 mils thick.

17. The retaining ring of claim 16, wherein the upper portion is thicker than the lower portion.

18. The retaining ring of claim 13, wherein the plastic is selected from the group consisting of polyphenylene sulfide, polyethylene terephthalate, polyetheretherketone, and polybutylene terephthalate.

19. The retaining ring of claim 18, wherein the plastic is polyphenylene sulfide.

20. The retaining ring of claim 13, wherein the metal is selected from the group consisting of steel, aluminum, and molybdenum.

21. The retaining ring of claim 13, wherein the metal has an elastic modulus about ten to one-hundred times the elastic modulus of the plastic.

22. The retaining ring of claim 13, wherein the lower portion is attached to the upper portion with an adhesive.

23. The retaining ring of claim 22, wherein the adhesive is an epoxy.

24. The retaining ring of claim 13, wherein the lower portion is press fit to the upper portion.

25. The retaining ring of claim 13, wherein the lower portion lacks any aperture from the top surface to the bottom surface of the lower portion.

26. The retaining ring of claim 13, wherein the bottom surface of the lower portion is substantially planar.

27. The retaining ring of claim 13, wherein the bottom surface of the lower portion has channels for slurry transport.

28. The retaining ring of claim 13, wherein the retaining ring has an inner side wall and an outer side wall, and the inner side wall and outer side wall are oriented vertically from the top surface of the upper portion to the bottom surface of the lower portion.

29. A retaining ring for a carrier head having a mounting surface for a substrate, comprising:

a generally annular lower portion having a bottom surface for contacting a polishing pad during polishing, the lower portion made of a first material that is substantially inert to a chemical mechanical polishing process and has a durometer measurement between about 80 and 95 on the Shore D scale and a first thickness between 100 and 400 mils; and a generally annular upper portion having a bottom surface secured to the lower portion and a top surface configured to be mechanically affixed to and abut a rigid base of a carrier head, wherein the upper portion is made of a second material which is more rigid than the first material and has a second thickness greater than the first thickness and an elastic modulus about ten to one-hundred times the elastic modulus of the first material, wherein the lower portion is secured to the upper portion and the top surface is configured such that the retaining ring is removable as a unit from the base so that the upper portion remains secured to the lower portion while the retaining ring is removed.

30. The retaining ring of claim 29, wherein the first material is a plastic.

31. The retaining ring of claim 30, wherein the plastic is selected from the group consisting of polyphenylene sulfide, polyethylene terephthalate, polyetheretherketone, and polybutylene terephthalate.

32. The retaining ring of claim 31, wherein the plastic is polyphenylene sulfide.

33. The retaining ring of claim 29, wherein the second material is a metal.

34. The retaining ring of claim 29, wherein the metal is selected from the group consisting of steel, aluminum, and molybdenum.

35. A retaining ring for a carrier head having a mounting surface for a substrate, comprising:

a generally annular lower portion having a bottom surface for contacting a polishing pad during polishing and a top surface, the lower portion made of a plastic; and a generally annular upper portion having a bottom surface secured to the top surface of the lower portion and a top surface configured to be mechanically affixed to and abut a rigid base of a carrier head, wherein the upper portion is made of a metal which is more rigid than the plastic, wherein the lower portion lacks any aperture from the top surface to the bottom surface of the lower portion, and wherein the lower portion is attached to the upper portion with an adhesive.

36. The retaining ring of claim 35, wherein the plastic is substantially inert to a chemical mechanical polishing process.

37. The retaining ring of claim 35, wherein the lower portion has a durometer measurement between about 80 and 95 on the Shore D scale.

38. The retaining ring of claim 35, wherein the lower portion is between about 100 and 400 mils thick.

39. The retaining ring of claim 38, wherein the upper portion is thicker than the lower portion.

40. The retaining ring of claim 35, wherein the plastic is selected from the group consisting of polyphenylene sulfide, polyethylene terephthalate, polyetheretherketone, and polybutylene terephthalate.

41. The retaining ring of claim 40, wherein the plastic is polyphenylene sulfide.

42. The retaining ring of claim 35, wherein the metal is selected from the group consisting of steel, aluminum, and molybdenum.

43. The retaining ring of claim 35, wherein the metal has an elastic modulus about ten to one-hundred times the elastic modulus of the plastic.

44. The retaining ring of claim 35, wherein the adhesive is an epoxy.

45. The retaining ring of claim 35, wherein the bottom surface of the lower portion is substantially planar.

46. The retaining ring of claim 35, wherein the bottom surface of the lower portion has channels for slurry transport.

47. The retaining ring of claim 35, wherein the retaining ring has an inner side wall and an outer side wall, and the inner side wall and outer side wall are substantially vertical from the top surface of the upper portion to the bottom surface of the lower portion.

48. The retaining ring of claim 13, wherein the top surface of the upper portion includes a hole to receive a fastener to mechanically affix the retaining ring to the base.

49. The retaining ring of claim 35, wherein the top surface of the upper portion includes a hole to receive a fastener to mechanically affix the retaining ring to the base.

* * * * *